US007234306B2

(12) United States Patent
Aumont et al.

(10) Patent No.: US 7,234,306 B2
(45) Date of Patent: Jun. 26, 2007

(54) GAS TURBINE COMBUSTION CHAMBER MADE OF CMC AND SUPPORTED IN A METAL CASING BY CMC LINKING MEMBERS

(75) Inventors: Caroline Aumont, Paris (FR); Eric Conete, Merignac (FR); Mario De Sousa, Cesson la Foret (FR); Didier Hernandez, Quiers (FR)

(73) Assignee: SNECMA, Paris (FR)

( * ) Notice: Subject to any disclaimer, the term of this patent is extended or adjusted under 35 U.S.C. 154(b) by 194 days.

(21) Appl. No.: 11/153,353

(22) Filed: Jun. 16, 2005

(65) Prior Publication Data

US 2006/0032235 A1 Feb. 16, 2006

(30) Foreign Application Priority Data

Jun. 17, 2004 (FR) ..... 04 06597

(51) Int. Cl.
*F23R 3/60* (2006.01)

(52) U.S. Cl. ..... 60/796; 60/753

(58) Field of Classification Search ..... 60/752, 60/753, 796, 800; 431/343
See application file for complete search history.

(56) References Cited

U.S. PATENT DOCUMENTS 4,191,011 A 3/1980 Sweeney et al.
5,291,732 A 3/1994 Halila
6,668,559 B2 * 12/2003 Calvez et al. ..... 60/796
6,675,585 B2 * 1/2004 Calvez et al. ..... 60/796
6,679,062 B2 * 1/2004 Conete et al. ..... 60/796
6,708,495 B2 3/2004 Calvez et al.
6,732,532 B2 5/2004 Camy et al.
2002/0184887 A1 12/2002 Calvez et al.
2002/0184892 A1 12/2002 Calvez et al.
2004/0032089 A1 2/2004 Conete et al.
2005/0000228 A1 1/2005 De Sousa et al.
2006/0010879 A1 * 1/2006 Aumont et al. ..... 60/796

FOREIGN PATENT DOCUMENTS

FR 2 825 781 A1 12/2002
FR 2 825 783 A1 12/2002
FR 2 840 974 A1 12/2003

* cited by examiner

*Primary Examiner*—L. J. Casaregola
(74) *Attorney, Agent, or Firm*—Rothwell, Figg, Ernst & Manbeck

(57) ABSTRACT

The annular combustion chamber having ceramic matrix composite material walls is mounted inside a metal casing by linking members fastened to the chamber by brazing. The linking members comprise a plurality of inner linking tabs and a plurality of outer linking tabs connecting the chamber to the inner and outer metal shrouds of the casing, each linking tab has a first portion fastened to the outside surface of a wall of the combustion chamber by brazing, the first portions of the linking tabs being spaced apart from one another circumferentially so that the brazed connections between the chamber and the linking members occupy a set of limited zones that are spaced apart from one another.

9 Claims, 4 Drawing Sheets

FIG.2
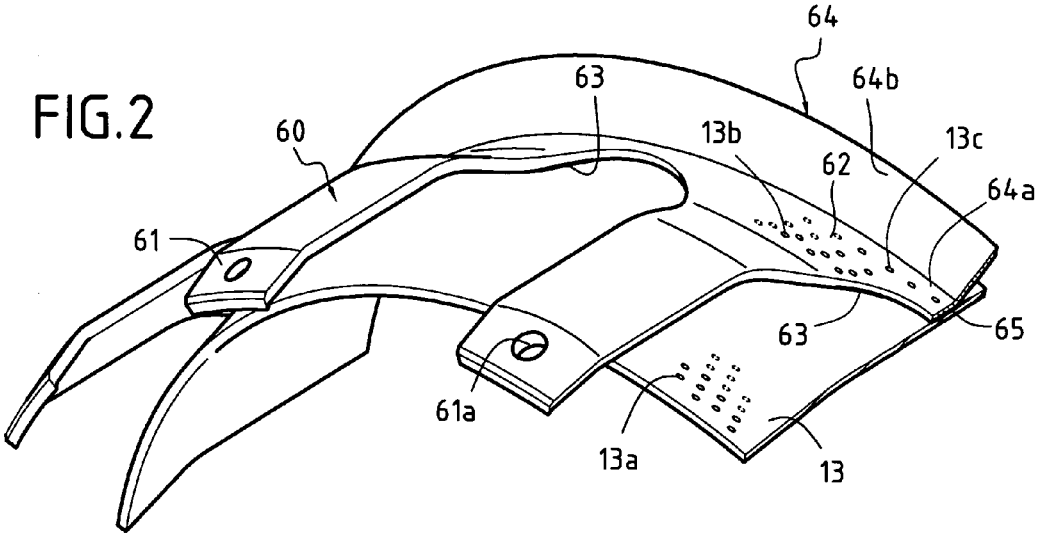
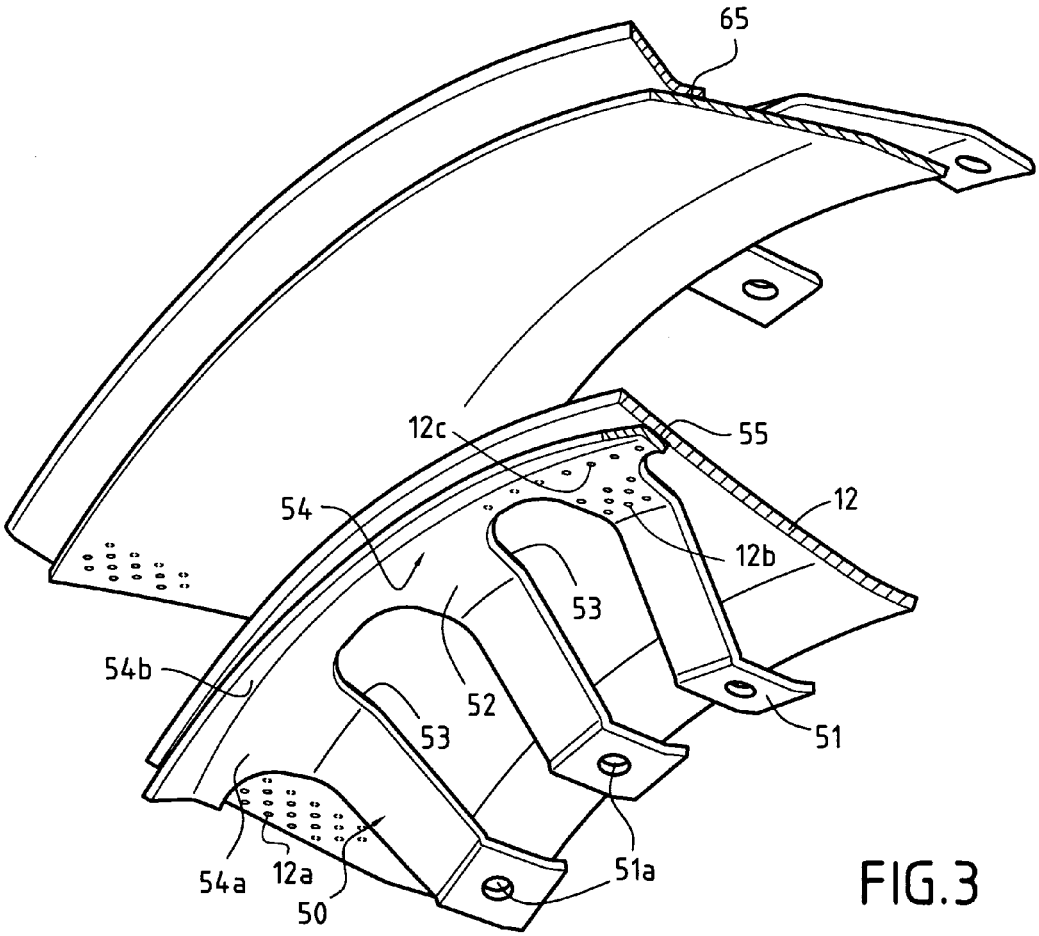
FIG.3

GAS TURBINE COMBUSTION CHAMBER MADE OF CMC AND SUPPORTED IN A METAL CASING BY CMC LINKING MEMBERS

BACKGROUND OF THE INVENTION

The present invention relates to mounting a combustion chamber having a wall made of ceramic matrix composite (CMC) material inside a metal casing, in a gas turbine. The field of application of the invention is more particularly that of industrial gas turbines and of turbojets or turboprops for airplanes.

It is common practice for a gas turbine combustion chamber to be made of metal and to be mounted or secured inside a metal casing by linking members, ferrules or tabs, that are made of metal. Using a metal for the wall of the chamber is appropriate so long as it is possible to ensure effective cooling of said wall. However, there is a need to increase temperatures within the combustion chamber in order to increase the efficiency of the gas turbine and reduce polluting emissions. The use of metals for combustion chamber walls can then become inappropriate, even when implementing cooling as effectively as possible. Proposals have therefore been made for the walls of combustion chambers to be made out of ceramic matrix composite materials, such as composite materials having a silicon carbide (SiC) matrix and presenting good strength at high temperatures.

A problem which then arises is that of connecting the CMC combustion chamber to the metal casing, because of the differences between their coefficients of thermal expansion.

Document FR 2 825 783 proposes connecting the inner and outer annular walls of a CMC combustion chamber of a gas turbine to inner and outer metal shrouds of a metal casing by means of elastically-deformable metal linking tongues. Those metal tongues are secured at one end to a metal ferrule fastened to the inner or outer metal shroud, and at an opposite end to a CMC ferrule that is brazed onto the outside face of an inner or outer wall of the combustion chamber.

Accommodating the differential changes in dimensions between the combustion chamber and the metal casing is thus made possible by the flexible linking tongues having CMC-on-CMC connections at the combustion chamber end and metal-on-metal connections at the casing end. However, the brazed connection between the CMC ferrule and the annular wall of the combustion chamber leads to real difficulties. An effective brazed connection requires the spacing between the surfaces that are to be brazed together to be well controlled in order to guarantee a uniform thickness of brazing material and in order to avoid harmful discontinuities in the brazing. Unfortunately, given the processes whereby CMC parts are manufactured, the dimensional tolerances thereof are greater than is the case for metal parts. It is therefore very difficult to guarantee uniform spacing between two complete annular surfaces that are to be connected together by brazing.

OBJECT AND BRIEF SUMMARY OF THE INVENTION

An object of the invention is to provide a combustion chamber having a CMC wall in a metal casing while avoiding the above problem.

This object is achieved by a gas turbine of the type having an annular combustion chamber with walls made of ceramic matrix composite material mounted inside a metal casing by linking members fastened to the chamber by brazing and connecting the chamber to inner and outer metal shrouds of the casing, in which gas turbine, according to the invention, the linking members comprise a plurality of inner linking tabs and a plurality of outer linking tabs which connect the combustion chamber to the inner and outer metal shrouds respectively, each linking tab having a first portion fastened to the outside surface of a wall of the combustion chamber by brazing, the first portions of said linking tabs being spaced apart from one another circumferentially so that the brazed connections between the chamber and the linking members are provided via a set of limited zones that are spaced apart from one another.

By limiting the dimensions of the zones of brazing, it is possible to make it easier to control the spacings between the surface portions to be brazed together, and thus avoid irregularities in brazing thickness. It is thus possible to obtain effective bonding by brazing.

Advantageously, the first portions of the inner linking tabs and of the outer linking tabs are integral with continuous inner and outer end ferrules respectively, defining bearing surfaces for annular sealing gaskets between the combustion chamber and a high pressure turbine nozzle situated immediately downstream from the chamber.

Also advantageously, the inner and outer end ferrules are made of ceramic matrix composite material and are made as a single piece together with the inner or outer linking tabs respectively.

The inner and outer end ferrules may be connected by brazing to the outside surfaces respectively of the inner and outer walls of the combustion chamber, the brazing being performed along continuous circumferential zones, in order to provide sealing between the inner and outer ferrules and the inner and outer walls of the chamber.

Since the mechanical connection is implemented via the brazing between the linking tabs and the walls of the combustion chamber, the brazing of the end ferrules on the walls of the chamber serves merely to provide circumferential sealing. It can therefore be performed over a narrow width, which is therefore easier to control, than would be possible if it were also to provide the mechanical connection.

In known manner, the inner and outer walls of the combustion chamber present a plurality of perforations allowing a cooling flow around the combustion chamber in the spaces between the chamber and the metal casing to maintain a protective film on the inside surface of the chamber walls. Since the brazing zones between the linking tabs and the walls of the combustion chamber are spaced apart from one another, they leave between them zones in which the multiple perforations through the chamber walls remain unaffected.

Nevertheless, perforations can also advantageously be made through the brazed zones of the linking members (CMC linking tabs and/or CMC end ferrules) and the walls of the combustion chamber so as to avoid the inside surface of the chamber walls presenting any zones that are not fed by perforations.

In an embodiment, each linking tab of ceramic matrix composite material has a second end portion fastened to the metal casing.

In another embodiment, the inner and outer linking tabs of ceramic matrix composite material are connected to the metal casing by respective inner and outer flexible metal linking parts. Under such circumstances, and advantageously, the inner and outer linking parts comprise inner and outer metal linking tabs each having a first end portion connected to a second end portion of a linking tab made of ceramic matrix composite material. The inner and outer metal linking tabs can then have second end portions that are secured to the inner and outer metal ferrules that are integral respectively with the inner and outer metal ferrules that are themselves secured to the inner and outer metal shrouds.

BRIEF DESCRIPTION OF THE DRAWINGS

The invention will be better understood on reading the following description given by way of non-limiting indication and with reference to the accompanying drawings, in which:

FIGS. 2 and 3 are fragmentary perspective views showing the linking members between the chamber and the casing and showing how they are connected by brazing to the walls of the combustion chamber in the embodiment of FIG. 1;

DETAILED DESCRIPTION OF EMBODIMENTS

Figure 1:
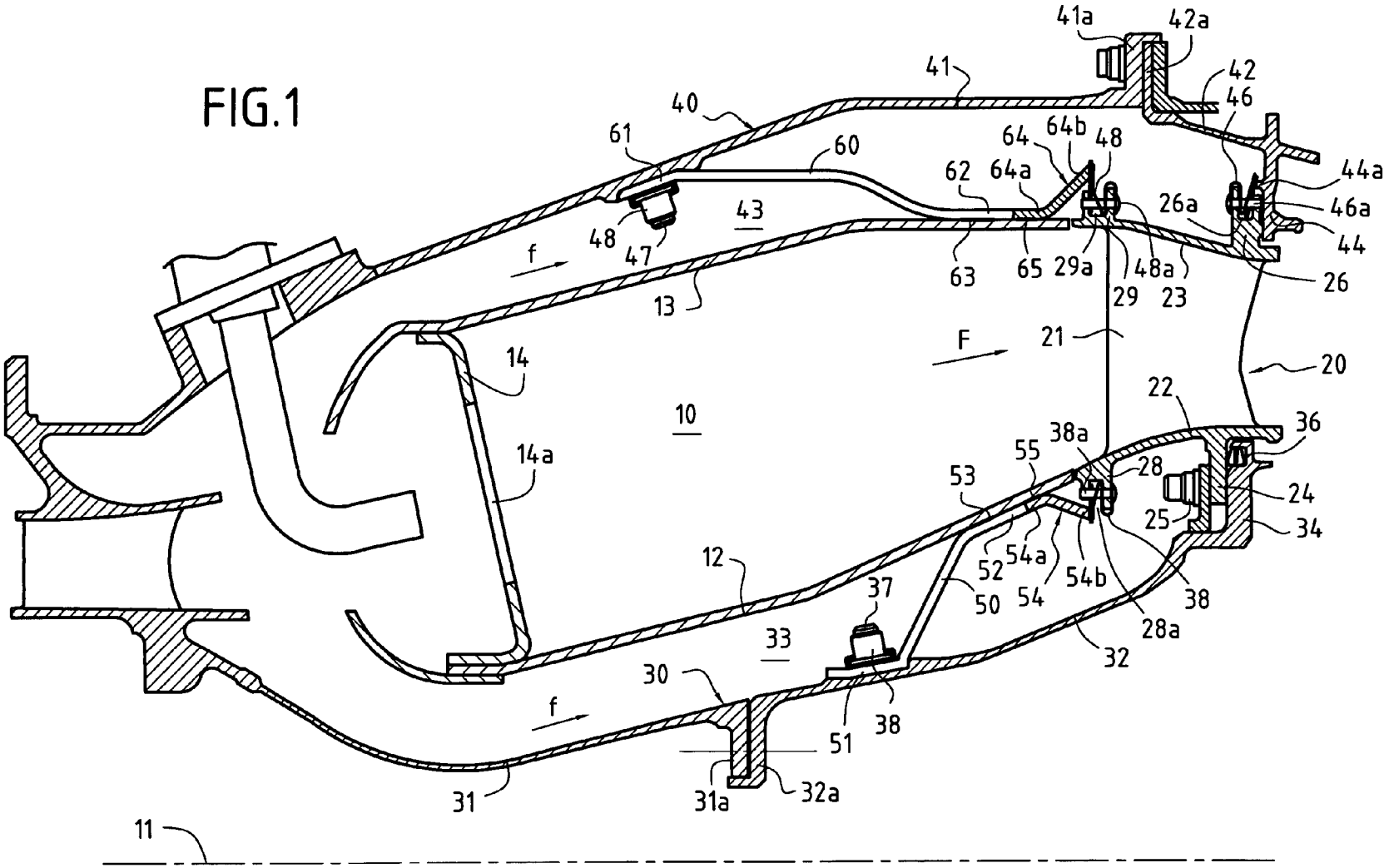
FIG. 1 is a fragmentary axial half-section view of a gas turbine showing an embodiment of the invention.

FIG. 1 is an axial half-section of a portion of a gas turbine comprising an annular combustion chamber 10, a high pressure turbine nozzle 20 disposed immediately downstream from the combustion chamber 10, a metal casing comprising inner and outer metal shrouds 30 and 40, and inner and outer linking tabs 50 and 60 holding the chamber 10 inside the metal casing. Below, the terms "upstream" and "downstream" are used relative to the flow direction (arrow F) of the gas stream coming from the chamber 10.

The combustion chamber 10 is defined by an inner annular wall 12 and an outer annular wall 13 sharing a common axis 11, and by an end wall 14 secured to the walls 12 and 13. In well-known manner, the end wall 14 presents openings 14*a* that are distributed around the axis 11 to house injectors for injecting fuel and oxidizer into the chamber 10. The walls 12 and 13 of the chamber 10 are made of CMC, e.g. a composite material having an SiC matrix, and optionally the wall 14 is made of the same material.

The HP turbine nozzle 20, which constitutes the inlet stage of the turbine, has a plurality of stationary vanes angularly distributed around the axis 11. The vanes comprise airfoils 21 whose ends are secured to inner and outer platforms 22 and 23 in the form of juxtaposed ring sectors. Each corresponding pair of platforms 22, 23 can be associated with one or more airfoils 21. The inside faces of the platforms 22 and 23 define the boundaries of the flow path within the nozzle for the gas stream coming from the combustion chamber.

The inner metal shroud 30 is made of two portions 31 and 32 that are united by bolting together respective inwardly-directed flanges 31*a* and 32*a*. Similarly, the outer metal shroud 40 comprises two portions 41 and 42 that are united by bolting together respective outwardly-directed flanges 41*a* and 42*a*. The space 33 between the inner wall 12 of the chamber 10 and the inner shroud 30, and the space 43 between the outer wall 13 of the chamber 10 and the outer shroud 40 convey a secondary stream of cooling air (arrows f) flowing around the chamber 10.

The nozzle 20 is mounted by a mechanical connection by bolting 25 between a radial flange 24 subdivided into sectors and secured to the inner platforms 22, and a radial flange 34 at the downstream end of the inner shroud 30. An annular sealing gasket 36, e.g. of the "omega" type closes the downstream end of the space 33 in leaktight manner. The gasket 36 is housed in a housing formed in the upstream surface of the flange 34 and presses against the downstream surface of the flange 24. The space 43 is closed in leaktight manner at its downstream end by a sealing gasket 46, e.g. of the strip type. The gasket 46 is held by pins 46*a* in an annular housing 26*a* in an annular flange 26 that is subdivided into sectors and that is integral with the outer platforms 23. The gasket 46 presses against a rib 44*a* formed on the upstream face of a radial flange 44 integral with the casing 40.

In the embodiment of FIGS. 1 to 3, the linking tabs 50 and 60 are made of CMC, and preferably out of the same material as the walls 12 and 13 of the chamber 10.

Each linking tab 50 has an end portion 51 connected by bolts to the inner metal shroud 30. On its inside surface, the shroud carries threaded rods 37 passing through holes 51*a* formed in the end portions 51 of the linking tabs 50 and having nuts 38 engaged thereon. Similarly, each linking tab 60 has an end portion 61 bolted to the outer metal shroud 40. On its inside surface, this shroud carries threaded rods 47 that pass through holes 61*a* formed in the end portions 61 of the linking tabs 60 and having nuts 48 engaged thereon.

The linking tabs 50 present end portions 52 that are connected to the outside surface of the inner wall of the chamber 10 by being brazed thereto in the vicinity of the downstream end of the chamber. The end portions 52 of the linking tabs 50 are integral with an inner ferrule 54. The ferrule 54 has an upstream annular portion 54*a* which is brazed to the outside surface of the wall 12 of the chamber, and a downstream portion 54*b* which is connected to the upstream portion 54*a* while making an obtuse angle relative thereto. At its downstream end, the ferrule 54 bears against an annular sealing gasket 38, e.g. of the strip type. The gasket 38 is held by pins 38*a* in an annular housing 28*a* of a flange 28 that is subdivided into sectors and that is integral with the platforms 22 in the vicinity of their upstream ends.

Similarly, the linking tabs 60 present upstream portions 62 which are connected to the outside surface of the outer wall 13 of the chamber 10 by being brazed thereto in the vicinity of the downstream end of the chamber. The end portions 62 of the linking tabs are integral with an outer ferrule 64. The ferrule 64 has an upstream annular portion 64*a* which is connected to the outside surface of the wall 13 of the chamber 10 by brazing, and a downstream portion 64*b* which is connected to the upstream portion 64*a*, while making an obtuse angle relative thereto. At its downstream end, the ferrule 64 bears against an annular sealing gasket 48, e.g. of the strip type. The gasket 48 is held by pins 48*a* in an annular housing 49*a* of a flange 29 that is subdivided into sectors and that is integral with the platforms 23 in the vicinity of their upstream ends.

The linking tabs 50 and the ferrule 54 are advantageously made as a single piece, as are the linking tabs 60 and the ferrule 64. Along their portions extending through the spaces 33 and 43, the linking tabs 50 and 60 are curved or folded in shape so as to present the flexibility necessary for accommodating differential dimensional variations between the walls of the chamber that are made of CMC and the shrouds 30 and 40 that are made of metal.

The combustion chamber is held essentially by the brazing at the end portions 52 and 62 of the linking tabs 50 and 60. Compared with continuous circumferential brazing, the brazing zones 53 and 63 are limited, such that it is possible to control the spacing between the surfaces that are to be brazed together without excessive difficulty.

The brazed connections between the portions 54*a*, 64*a* of the ferrules 54, 64 and respectively the walls 12, 13 of the chamber 10 extend continuously in the circumferential direction. These brazed connections serve to provide sealing between the spaces 33, 43 and the downstream end of the chamber 10 so as to avoid any uncontrolled injection of cooling flow through the interface between the chamber 10 and the turbine nozzle 20. Such connections do not need to hold the chamber mechanically, since that function is provided by the brazing at the portions 52, 62 of the linking tabs 50, 60. Consequently, the bonding zones 55, 65 between the ferrules 54, 64 and the walls 12, 13 of the chamber 10 can be limited in width, thus also making it very easy to control the spacing between the surfaces to be brazed together. The brazed connections between the ferrules 54, 64 and the chamber 10 thus contribute to the stability of the linking tabs 50, 60 in the event of an angular displacement.

Brazing parts made of CMC is a known technique. Both for the connections between the linking tabs 50, 60 and the chamber 10 and for the connections between the ferrules 54, 64 and the same chamber, it is possible to perform brazing using a material such as "BraSiC" as developed by the French public body "Commissariat à l'Energie Atomique" [Atomic Energy Commissariat] or "Ticusil" from Wesgo Metals, in particular when the brazed parts are made of SiC matrix composite material.

The walls 12, 13 of the chamber 10 may present multiple perforations to allow cooling air to flow from the spaces 33, 43 to the inside surfaces of the walls 12, 13 in order to maintain a cooling film along said surfaces. The perforations 12*a*, 13*a* are shown in part, in FIGS. 2 and 3 only. The gaps between the brazed zones 53, 63 leave portions of the chamber walls where the multiple perforations can be present, thereby improving thermal protection of the walls. If desirable, multiple perforations may also be provided through the brazed end portions 52, 62 of the linking tabs 50, 60 and the chamber walls 10, and through the brazed portions between the ferrules 54, 64 and the walls of the chamber 10. These multiple perforations can be made after brazing, e.g. in conventional manner by laser machining. Such perforations 12*b*, 12*c*, and 13*b*, 13*c* are shown in part, solely in FIGS. 2 and 3.

Figure 4:
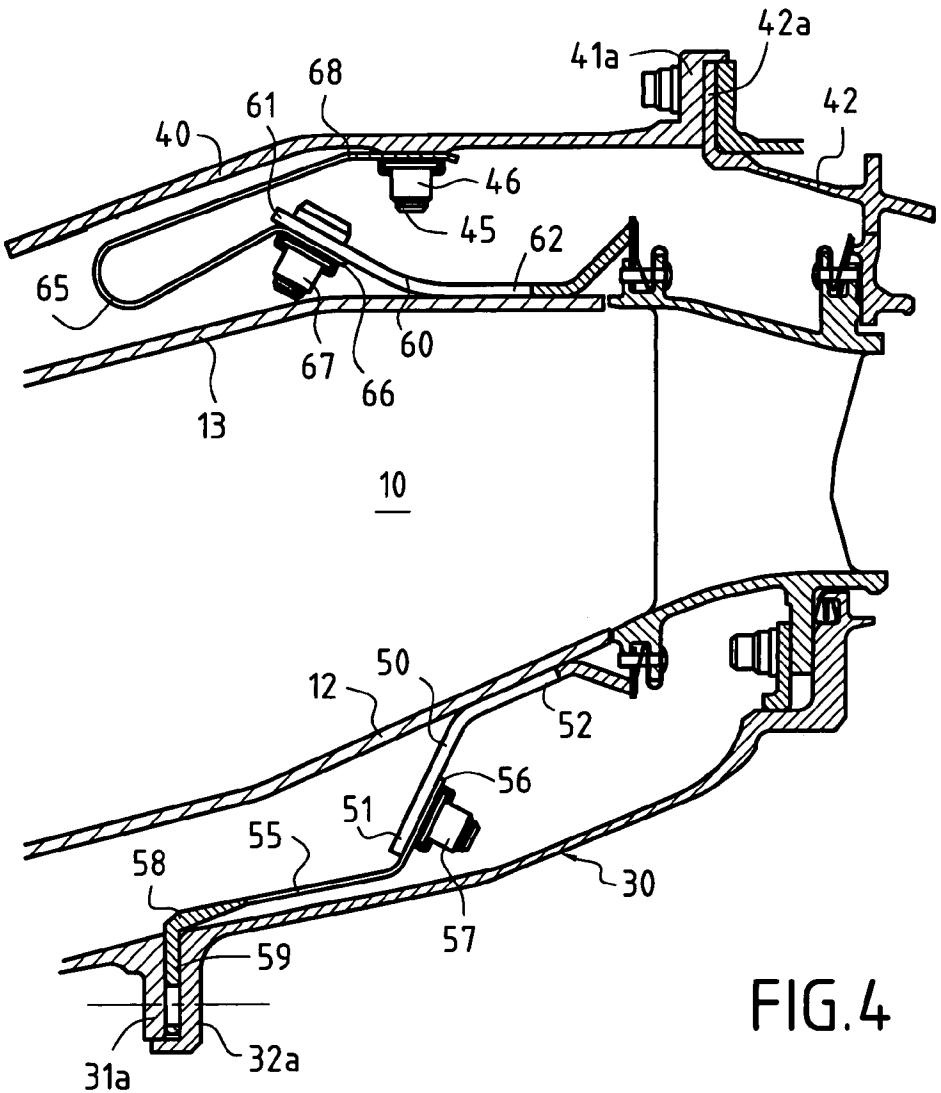
FIG. 4 is a fragmentary axial half-section view of a gas turbine showing another embodiment of the invention.
Figure 6:
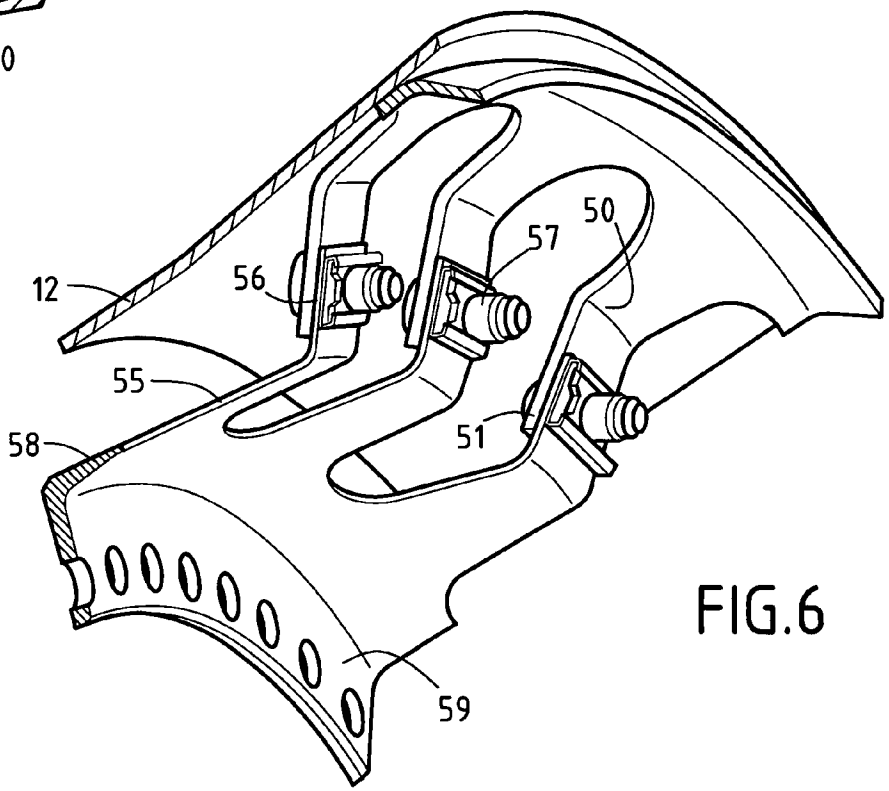
FIGS. 5 and 6 are fragmentary perspective views showing the linking members between the chamber and the casing and showing their brazed connections with the walls of the combustion chamber in the embodiment of FIG. 4.
Figure 5:
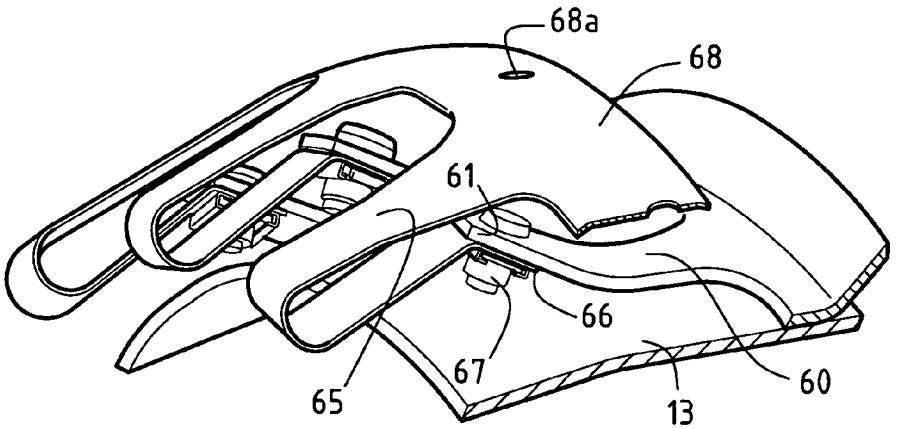

FIGS. 4 to 6 show an embodiment which differs from that of FIGS. 1 to 3 essentially in that the CMC linking tabs 50, 60 have their ends 51, 61 connected to the metal shrouds 30, 40, not directly, but via flexible or elastically-deformable metal tabs. Elements that are common to the embodiment of FIGS. 1 to 3 and to the embodiment of FIGS. 4 to 6 are given the same references and are not described again.

Each metal tab 55 has an end portion 56 connected by bolting (57) to one end 51 of a corresponding tab 50, while its other end is integral with an annular metal ferrule 58. This ferrule constitutes an annular flange 59 that is connected to the shroud 30 by being clamped between the flanges 31*a* and 32*a*.

Each metal tab 65 has an end portion 66 connected by bolting (67) to one end 61 of a corresponding tab 60 and its other end is integral with an annular metal ferrule 68. This ferrule has holes 68*a* with threaded rods 45 passing therethrough that are secured to the shroud 40 and that have nuts 46 engaged thereon.

Naturally, the ferrule 68 could be connected to the shroud 40 in the same manner as the ferrule 58 is connected to the shroud 30, i.e. by means of a flange clamped between the flanges 41*a* and 42*a*. Conversely, the ferrule 58 could be connected to the shroud 30 by bolting in the same manner as the ferrule 68 is connected to the shroud 40.

The metal tabs 55 are advantageously made as a single piece together with the ferrule 58, and the same applies to the metal tabs 65 and the ferrule 68.

The metal tabs 55, 65 serve to increase the possibly-insufficient ability of the tabs 50 and 60 made of CMC to deform elastically. In order to present the necessary degree of elastic deformation or flexibility, the tabs 55, 65 are curved or folded so as to have a profile that is substantially S-shape (tabs 55) or V-shape (tabs 65).

What is claimed is:

1. A gas turbine having an annular combustion chamber with walls made of ceramic matrix composite material mounted inside a metal casing by linking members fastened to the chamber by brazing and connecting the chamber to inner and outer metal shrouds of the casing, wherein the linking members comprise a plurality of inner linking tabs and a plurality of outer linking tabs which connect the combustion chamber to the inner and outer metal shrouds respectively, each linking tab having a first portion fastened to the outside surface of a wall of the combustion chamber by brazing, the first portions of said linking tabs being spaced apart from one another circumferentially so that the brazed connections between the chamber and the linking members are provided via a set of limited zones that are spaced apart from one another.

2. A gas turbine according to claim 1, wherein the first portions of the inner linking tabs and of the outer linking tabs are integral with continuous inner and outer end ferrules respectively, defining bearing surfaces for annular sealing gaskets between the combustion chamber and a high pressure turbine nozzle situated immediately downstream from the chamber.

3. A gas turbine according to claim 2, wherein the inner and outer end ferrules are made of ceramic matrix composite material and are made as a single piece together with the inner or outer linking tabs respectively.

4. A gas turbine according to claim 2, wherein the inner and outer end ferrules are connected by brazing to the outside surfaces respectively of the inner and outer walls of the combustion chamber, the brazing being performed along continuous circumferential zones.

5. A gas turbine according to claim 1, wherein perforations for bringing a flow of cooling air along the inside surfaces of the chamber wall are formed through the brazed-together zones of the linking members and the chamber walls.

6. A gas turbine according to claim 1, wherein each linking tab of ceramic matrix composite material has a second end portion fastened to the metal casing.

7. A gas turbine according to claim 1, wherein the inner and outer ceramic matrix composite material linking tabs are connected to the metal casing via respective inner and outer flexible metal linking parts.

8. A gas turbine according to claim 7, wherein the inner and outer metal linking parts comprise inner and outer metal linking tabs each having a first end portion connected to a second end portion of a linking tab made of ceramic matrix composite material.

9. A gas turbine according to claim 8, wherein the inner and outer metal linking tabs have second end portions integral with respective inner and outer metal ferrules fastened to the inner and outer metal shrouds.

* * * * *